United States Patent [19]

Nasca et al.

[11] Patent Number: 5,042,218

[45] Date of Patent: Aug. 27, 1991

[54] RE-BAR SUPPORT

[76] Inventors: Gerald Nasca, 8322 Chester Dr., Sacramento, Calif. 95830; H. F. Frost, 9689 Kent St., Elk Grove, Calif. 95624; Theodore A. Nasca, 8322 Chester Dr., Sacramento, Calif. 95830

[21] Appl. No.: 411,830

[22] Filed: Sep. 25, 1989

[51] Int. Cl.[5] ..... E04C 5/16

[52] U.S. Cl. ..... 52/677; 52/699

[58] Field of Search ..... 56/677-689; 52/692-701, 426; 249/216, 219.1

[56] References Cited

U.S. PATENT DOCUMENTS

| | | | |
|---|---|---|---|
| 1,126,190 | 1/1915 | Fuehrer | 249/216 |
| 1,561,323 | 11/1925 | Gregg | 52/687 |
| 1,775,234 | 9/1930 | Brostrom | 52/681 |
| 1,788,180 | 6/1931 | White | 52/677 |
| 1,924,724 | 8/1933 | Olney | 52/677 |
| 2,020,407 | 11/1935 | Forster | 52/680 |
| 2,848,888 | 8/1968 | Jones | 52/684 |
| 2,901,807 | 9/1959 | Helmerson . | |
| 3,102,614 | 9/1963 | Lydard | 52/35 |
| 4,193,573 | 3/1980 | Kinnucan, Jr. | 249/9 |
| 4,301,638 | 11/1981 | Schmidgall | 52/687 |
| 4,524,553 | 6/1925 | Hacker | 52/169.11 |
| 4,640,063 | 3/1987 | Ayala | 52/127.3 |
| 4,739,598 | 4/1988 | Jensen et al. | 52/295 |
| 4,742,655 | 5/1988 | Kovasna | 52/98 |

*Primary Examiner*—James L. Ridgill, Jr.
*Attorney, Agent, or Firm*—Bernhard Kreten

[57] ABSTRACT

A hanger which is adapted to be draped on a form board which is used as a side abutment when pouring concrete foundations or footings. The hanger when properly oriented serves as a support vehicle for a plurality of re-bars which are intended to be embedded in the concrete once it is poured. In use, the hangers include re-bar recess receptacles which allow the re-bars to be snapped into place on the hanger and held in fixed position. Various hangers of diverse dimensions allow a plurality of different re-bars to be supported from a single form so that after the concrete is poured and the concrete has set, a portion of the hanger which was draped upon the form can be removed to allow removal of the form for providing a finished foundation footing.

19 Claims, 3 Drawing Sheets

RE-BAR SUPPORT

FIELD OF THE INVENTION

The following invention relates generally to instrumentalities which hold re-bars in place for precise orientation when pouring concrete. More specifically, the instant invention is directed to a wire hanger which is supported by a form board. The hanger receives a re-bar and holds the re-bar in spaced relation from the form board to assure that the re-bar is precisely placed in the concrete to be poured, thereby assuring structural rigidity of the finished concrete.

BACKGROUND OF THE INVENTION

The construction industry is one of the most challenging and competitive endeavors. Frequently its rigors leave ample opportunity for a builder's profit to vanish. Bidding on proposed work, changes in the state of the art, completion of specialized tasks on a critical path method, and satisfying the subjective predilections of contractor and prospective purchaser while conforming to the prescribed building codes of the locale can all provide pitfalls.

Paradoxically, although many aspects of construction are labor intensive, relatively modest progress has been made in streamlining certain labor intensive endeavors. For example, when pouring concrete it is frequently necessary to reinforce the concrete by positioning reinforcing steel, or re-bars, in strategic locations within the concrete so that the resulting structure has greater strength than had the concrete been poured alone. In order the achieve the ultimate objective associated with installation of re-bar in concrete, it is imperative that the re-bar be strategically oriented for maximum benefit. One area of concrete work that contractors find most labor intensive involves the pouring of footings because it is difficult to position the re-bar properly.

When footings are poured, the re-bar is to be strategically placed within the footing. Because the footings support the remainder of the building, they ultimately absorb all of the load imposed thereon by the overlying building structure. Accordingly, accurate placement of re-bar is quite critical at the foundation and is the subject of considerable scrutiny by inspectors working on behalf of the municipality.

As mentioned briefly supra, re-bars work most effectively when imbedded in concrete. Not surprisingly therefore, one basis by which an inspector will fault a contractor's foundation involves having the re-bar exposed or protruding out from the concrete. This presents a plurality of problems, since it is clear that the re-bar is not strategically oriented to do its intended job, and besides being aesthetically unsightly, exposed re-bar provides an inherent area of weakness leading to degradation of the foundation structure. Moreover, out of place re-bar adversely effects placement of subsequent structure and moves a flush exterior which is rightfully equated with quality workmanship.

Surprisingly, inaccurate placement of re-bar is common, because there are no effective techniques in orienting the re-bar in a labor-saving, efficient manner. Typically, a form board is placed within a trench that is to house the footing, and the form board is suitably supported to receive the load expected by pouring concrete within the trench. Scrap lumber is draped over the trench and re-bar is suspended from the scrap lumber by means of wire which extends between the scrap lumber and the re-bar, and is oriented by "line of sight". Although the footings themselves are carefully surveyed for accuracy, the re-bar therewithin is haphazardly oriented. Since surveying is used to locate the form boards for accurate placement of the footings, the form board serves as an accurate basis by which and from which re-bars could be oriented.

The following patents reflect the state of the art of which applicant is aware and are included herewith in order for applicants to discharge their acknowledged duty to disclose relevant prior art. It is respectfully stipulated that none of these patents singly nor in any conceivable combination teach or render obvious that which is the nexus of the instant invention as set forth here and after.

| | |
|---|---|
| Ayala | 4,640,063 |
| Helmerson | 2,901,807 |
| Schmidgall | 4,301,638 |
| Hacker | 4,524,553 |
| Lydard | 3,102,614 |
| White | 1,788,180 |
| Kinnucan, Jr. | 4,193,573 |
| Jensen, et al. | 4,739,598 |
| Kovasna | 4,742,655 |

The patent to Ayala teaches the use of a support clip which is configured to slip over the top edge over a form and snugly connect thereto. An opposite end of the clip is formed into a spring biased section which includes a pocket. Within the pocket there is located a place for supporting a reinforcing bar. With the bar located in the pocket, the bar is snugly held in an established position against the form for support during the pour.

SUMMARY OF THE INVENTION

The instant invention is distinguished over the known prior art in a plurality of ways. For one, the instant invention is configured as a hanger which is installed and utilized more rapidly than the known prior art.

More specifically, the instant invention is configured initially as an inverted U-shaped clamp having a bight portion which rests upon a top surface of a form board while inverted leg portions of the U-shaped clamp straddle the sides of the form board. One leg exhibits various configurations and is adapted to receive at least one re-bar in spaced relation out and away from the form board. A free end of this one leg is directed inwardly, towards the form board with a pointed end resting against a side surface of the form board, still within the area to receive concrete and serving as a cantilevered support for the re-bar. When the hanger according to the instant invention is used, the re-bar is assured of accurate placement, time after time with a minimal amount of labor. Thus, the re-bar has been accurately oriented with respect to the form board and therefore fulfills its role in stabilizing and strengthening the concrete.

Once the concrete has been poured and has been allowed to set, the form board in most cases is stripped away from the concrete. This can be also achieved according to the instant invention by having the one leg of the U-shaped inverted clamp which is outboard of the pour to have an outwardly extending purchase area which can be contacted with a claw from a claw hammer, commonly found on most construction sites. The bight portion of the U-shaped clamp which lies on a top surface of the form board can readily be removed along with the outboard leg by providing a scoreline or an area of weakness at the transition between the bight portion and the leg of the U-shaped clamp which is embedded in the pour. By breaking off the outboard leg and the bight portion of the U-shaped clamp, and removal of the form board, a major portion of the hanger remains within the concrete along with the re-bar, providing additional strength.

In various forms of the invention, provision is made to support at least two re-bars spaced one from another with one hanger. When a plurality of different shaped hangers are to be used, multiple hangers will allow multiple re-bars to be held in spaced relations with respect to the form board at different distances.

OBJECTS OF THE INVENTION

Accordingly, it is a primary object of the present invention to provide a novel and useful hanger for use in holding re-bars in fixed position to facilitate pouring footings or the like.

A further object of the present invention is to provide a device of the character described above which is easy to install on the job site and therefore not as labor intensive as known prior art devices.

A further object of the present invention entails providing a device of the character described above which can readily release the associated form board against which it is initially supported.

A further object of the present invention is to provide a device of the character described above which is extremely durable in construction, lends itself to mass production techniques and is extremely safe to use.

A further object of the present invention is to provide a device of the character described above which will benefit from reductions in price by virtue of mass production techniques.

A further object of the present invention is to provide a device as characterized above which increases the likelihood that the re-bar will be properly oriented and therefore pass inspection, while concomitantly increasing the strength of the foundation at least to predictable pre-engineered specifications.

Viewed from one vantage point, it is an object of the present invention to provide a hanger which supports conventional re-bar a certain distance from a form which is used to contain concrete when pouring a footing, which includes an inverted U-shaped retainer clamp dimensioned to fit and depend from a top portion of the form. The retainer clamp has a bight portion which girds a top area of the form with an inboard leg and an outboard leg. The outboard leg includes a turnout which makes it easy for a craftsman to grasp the turnout with a claw hammer. The inboard leg and its juncture with the bight portion of the U-shaped retainer includes a weakened area defined by a scoreline which allows the bight portion and the outboard leg to be broken off once the outboard turnout has been pulled on with the claw hammer. The outboard leg and the bight portion are only removed once the concrete has been poured and settled so that the form board can be removed, leaving only a "point" exposed on an edge of the concrete which corresponds to the cross sectional diameter of the wire used to form the hanger.

Viewed from a second vantage point, it is an object of the present invention to provide a hanger of the character described in the preceding paragraph where the hanger has another end remote from the exposed end which initially is balanced against the form board at a lower inboard surface, holding the hanger in cantilevered relationship out into the space which is to receive the concrete pour. After the concrete is poured, and the form board is removed, the tip associated with the cantilevered leg remains exposed on the side surface of the concrete footing.

Viewed from yet a third vantage point, it is an object of the present invention to provide each hanger with a re-bar recess into which one or more re-bars can be placed and retained therein. In order the assure that the re-bar recess reliably holds the re-bar in position, the recess is formed from the one strand of wire bent such that a hairpin catch exists at the mouth of the recess serving as a retaining catch to keep the re-bar in position and from dislodgement should it be jostled. Other hanger structure communicates the re-bar recess with the cantilevered leg, its tip, and the inboard leg terminal portion giving flexibility in orienting the re-bar recess along the form. Various embodiments involve placement of the re-bar recess in different angular and spacial relationships with respect to the form board and also the number of recesses associated with a single hanger.

Viewed from yet a further vantage point, it is an object of the present invention to provide a method for mixing and matching various diverse hangers in outwardly extending relation from the form board oriented such that a plurality of re-bars can be placed within the diverse hangers without interference of one hanger and its associated re-bar and an adjacent hanger which may have different dimensions and associated re-bars. In this way, clusters of re-bar can be associated with discretely dimensioned hangers without interference from adjacent hangers.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENTS

Figure 1:
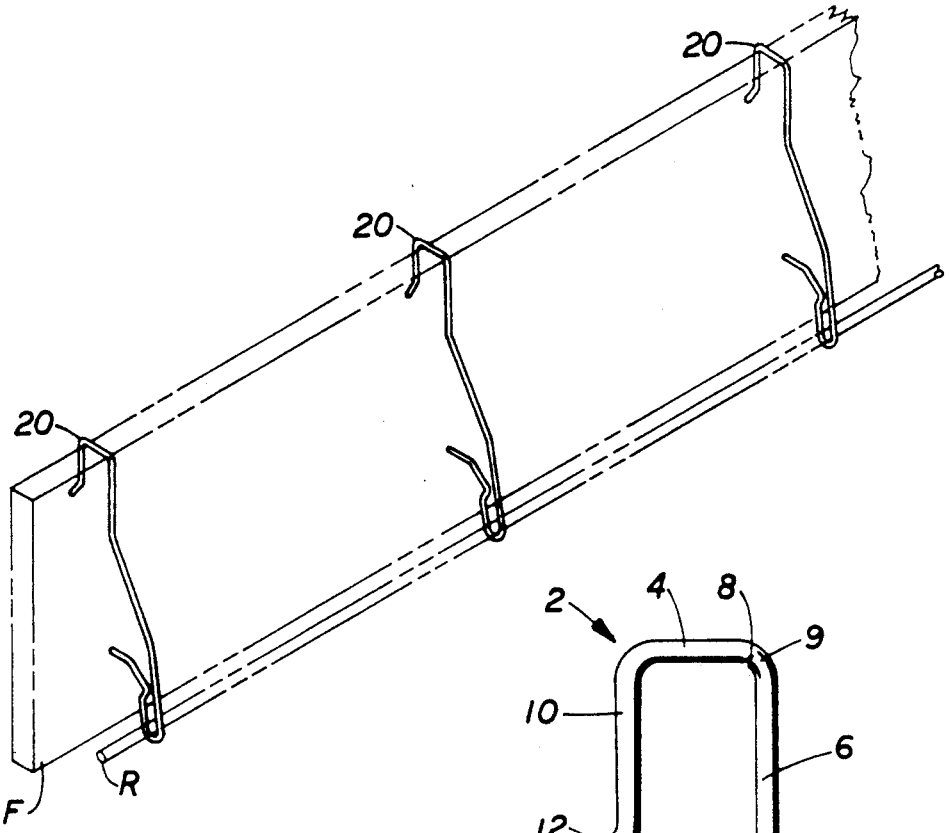
FIG. 1 is a perspective view of one type of hanger in its intended environment, according to the present invention.

Referring to the drawings now, wherein like reference numerals refer to like parts throughout the various drawing figures, reference numerals 20, 30 and 40 are directed to the hanger according to the illustrative embodiments of the present invention.

Figure 3:
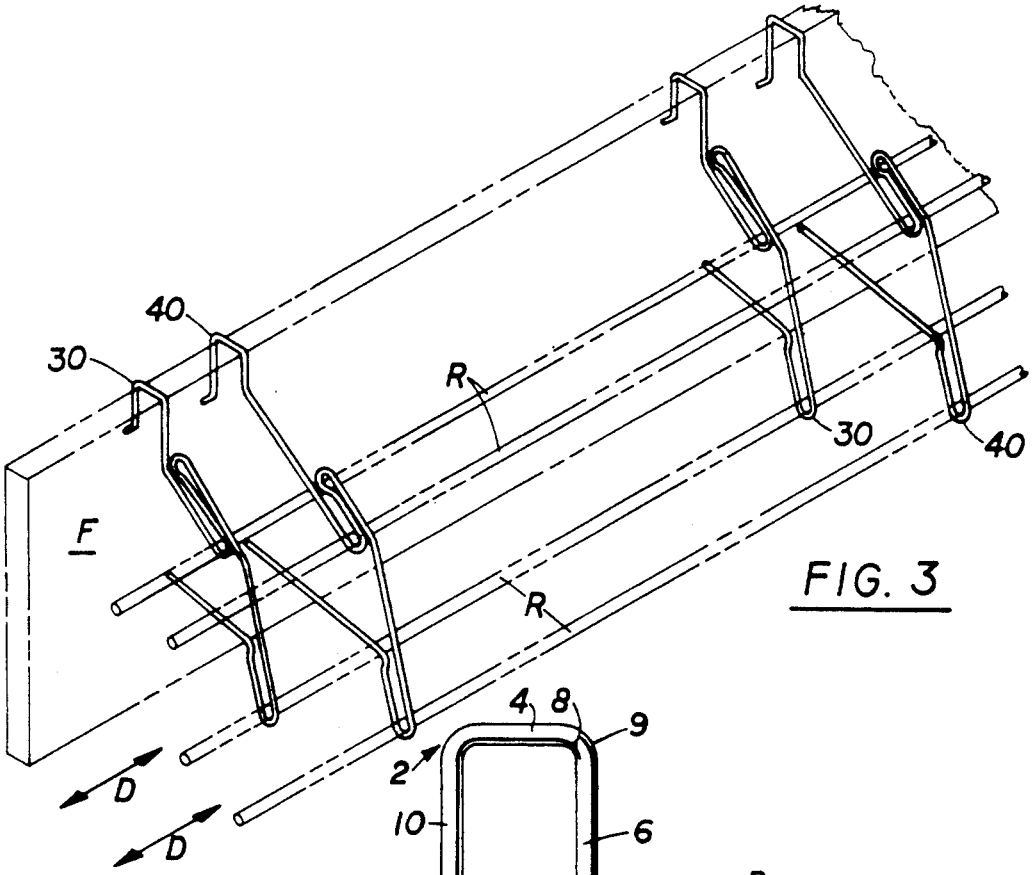
FIG. 3 is a perspective view of two types of hangers of different configuration oriented in its intended environment.

In its essence, each of the hangers as shown in FIGS. 1 and 3 are adapted to be draped on a form board F and spaced one from the other such that they can support the weight of re-bars R and can be oriented within the concrete to be poured with a minimal amount of orientation or labor intensive effort. Each of the hangers includes an inverted substantially U-shaped retainer clamp having a bight portion and an inboard leg and an outboard leg. The outboard leg includes a turnout which allows a claw hammer or other instrument to pry the outboard leg and bight portion up. The inboard leg is provided with a score or weakened are near the bight portion which allows the hanger to be broken off at the juncture of the bight portion and the inboard leg. This break is to be made after the concrete pour and leaves a minimal amount of wire exposed from the concrete. Each hanger includes a plurality of re-bar recesses having a hairpin catch adjacent a mouth of the recess and re-bar is fed past the catch and the mouth into the recess for support therein until the concrete pour is made. The various hangers differ from each other in the extent to which the re-bar recesses are cantilevered out away from the form.

Figure 2:
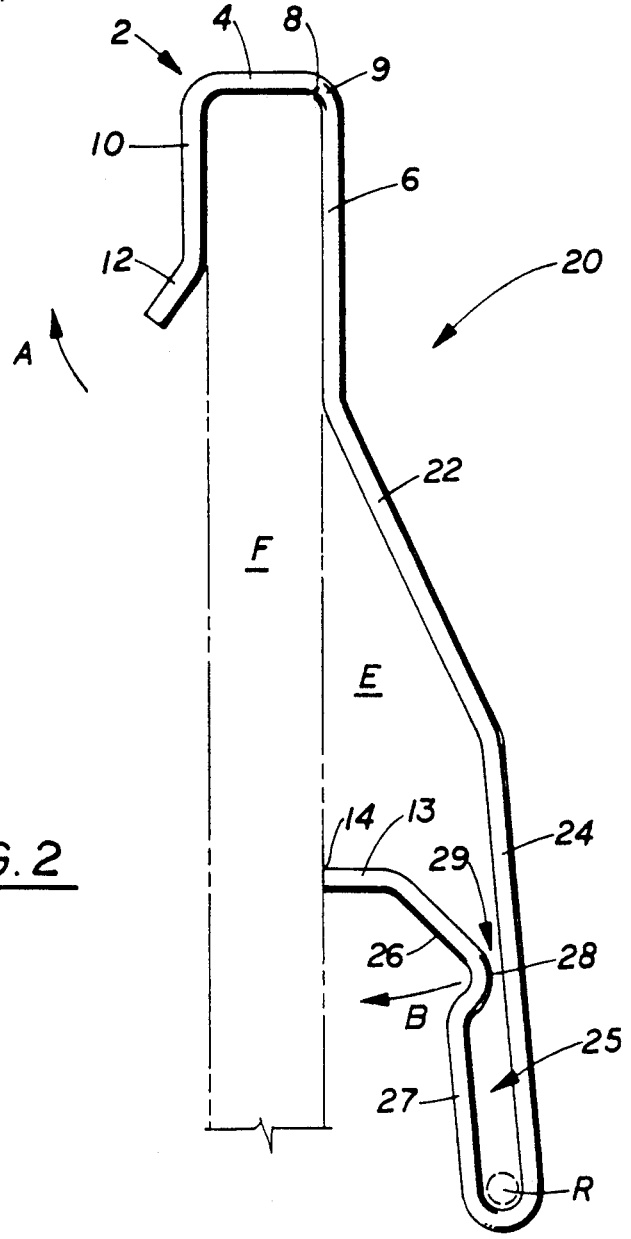
FIG. 2 is a plan view of one of the hangers shown in FIG. 1.

More specifically, and with respect to FIGS. 1 and 2, there is shown a first hanger 20 according to the present invention. As shown, the hanger 20 includes a clamp means 2 for retaining the hanger 20 on a form board F. Traditionally, when pouring footings, a form board is placed on one side of the concrete to be formed, serving as a mold or guidewall. The concrete is traditionally poured in a trench and the extent of the concrete is circumscribed by the configuration of the form board or boards which channel the concrete. The hanger 20 includes an inverted U-shaped retainer clamp 2 formed with a bight portion 4 oriented to rest on a top surface of the form F, an outboard leg 10 extending downwardly which includes a turnout 12 and an inboard leg 6 connecting the bight portion. Leg 6 is provided with a score or weakened area 8 along the juncture between the bight and inboard leg. In use and operation, once the concrete has been poured and settled, the inboard leg 6 will be ensconced in concrete at least on all sides thereof except where there is tangential contact with the form board. By using the turnout 12 and bending upwardly in the direction of the arrow A, the major portion of the U-shaped retainer will be removed by fracture at the weakened area 8, thereby removing the bight portion 4, the outboard leg 10 and the turnout 12. All that remains, will be the terminal portion 9 adjacent the weakened area 8 and the inboard leg 6.

FIG. 2 reflects an embodiment in which a single recess 25 is provided for re-bars R. In general, the recess 25 includes a mouth 29 through which the re-bar passes. In order to fictionally retain the re-bar within the recess, a hairpin catch 28 narrows the mouth 29 to provide resistance for the re-bar's passage both in and out of the recess. By providing force in the direction of the arrow B a re-bar will pass beyond the mouth. The hanger 20 is formed from a class of materials having sufficient resiliency and memory to be forgiving in the presence of the kind of force required to distort the mouth 29 by pressure against the catch 28. When the force B has been removed, the catch returns to its closed, lock position, retaining one or more re-bars R in the recess 25. In its essence, the recess 25 is formed from the juncture of a pair of recess legs 24 and 27 communicating at a lower curved portion within which the re-bar resides. The recess legs 27 and 24 ultimately communicate with areas of contact with the form as will be discussed.

More particularly, a one recess leg 24 connects to the inboard leg 6 by means of a wall spacer leg 22 extending therebetween. Leg 22 is angled outwardly and downwardly from the inboard leg 6 as shown in FIG. 2.

Similarly, the other recess leg 27 communicates with the form F by means of a cantilevered tip 14 initially placed in abutting contact against the form F and which holds the hanger 20 perpendicularly out from the form. The tip 14 communicates with the recess leg 27 by means of a cantilevered leg 13 extending from the tip 14 and a transition leg 26 extending from the cantilevered leg 13 and to the mouth of the hairpin catch 28. Thus, the transition leg 26 communicates with the recess leg 27 through the catch 28 and declinates downwardly and outwardly.

In use and operation, re-bar is placed within the recess 25 by forcing open the mouth 29 of the hairpin catch 28 distorting same in the direction of the arrow B and allowing the re-bar R to be placed within the recess 25. Absence of the force B required to distort the mouth and catch 28 will cause the catch 28 to revert to its original at rest position, pictured in FIG. 2. As shown in FIG. 1, a plurality of such hangers are draped on a form F to support one or more re-bars R. With the configuration thus described, there are two natural nesting sites for re-bar. The re-bar shown in phantom in FIGS. 1 and 2, and at a second enclosed area E just above the mouth 29 of the catch 28. Use of this hanger will assure that the re-bar is maintained in its desired location when pouring the concrete, and a minimal amount of labor is involved in assuring that the re-bar is properly oriented.

Figure 4:
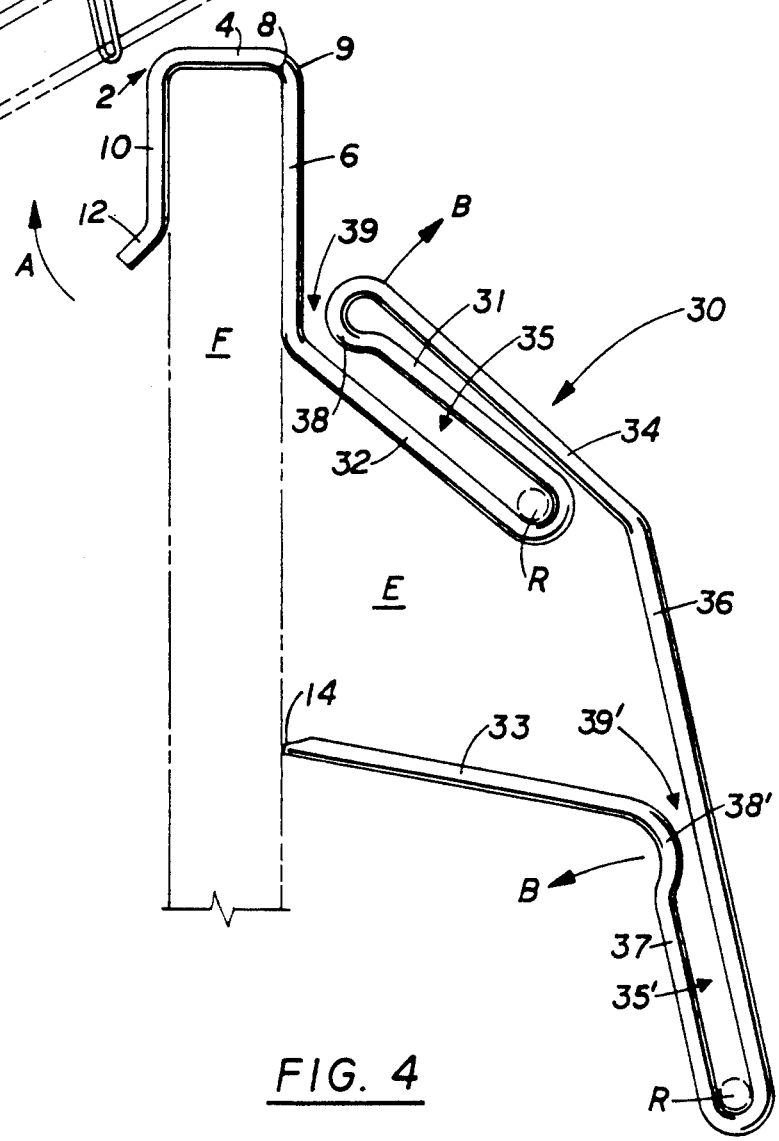
FIG. 4 is a plan view of one of the hangers in FIG. 3.

FIG. 4 reflects a second embodiment having variations which will be explored in detail here, while the similarities with FIG. 2 will merely be itemized. As shown, the second embodiment of the hanger 30 includes the inverted U-shaped retainer clamp 2 having the bight portion 4, the inboard leg 6, the scoreline 8, the terminal portion 9, the outboard leg 10 and the turnout 12. In addition, the device includes the cantilevered tip 14 and a cantilevered leg 33. The cantilevered leg 33 extends at a somewhat different a angle when compared with FIG. 2. Thus, while the cantilevered leg 13 of FIG. 2 is more horizontal, the cantilevered leg 33, of FIG. 4 declinates downwardly and outwardly at a greater, more pronounced slope. It should be pointed out that these angles are merely illustrative and the hanger can assume a wide variety of different contours.

Similar to the first embodiment 20, the second embodiment 30 includes a lower re-bar recess 35'. A mouth 39' allows communication of a plurality of re-bars R by distorting a catch 38' in the direction of the arrow B. Apart from the length and angulation of the cantilevered leg 33, the thus far described hanger 30 is similar to the first embodiment. The re-bar recess 35' includes first and second recess legs 36, 37. The leg 37 communicates with the cantilevered leg 33 via the catch 38'. The other recess leg 36 extends upwardly and allows communication with a second re-bar recess 35. This re-bar recess 35 is formed at the terminal portion of the inboard leg 6 and includes a pair of recess legs 31, 32 which define the recess 35 and a catch 38 associated with a mouth 39 for the reception of re-bars R therewithin upon distorting the catch 38 in the direction of the arrow B. A switchback leg 34 extends from the hairpin catch 38 to the lower recess leg 36 as shown in FIG. 4.

FIG. 3 shows two of the hangers 30 oriented on a form F and supporting upper and lower re-bars R as thus far described. Note that the two mouths 39 and 39' of the second hanger 30 allow feeding of re-bar rod R in somewhat different manners. The upper mouth 39 can receive re-bar by merely laying the re-bar adjacent to mouth and "snapping" the re-bar into place by deforming the catch 38 in the direction of the arrow B. For the lower recess 35', an enclosed area E suggests that the re-bar must either be threaded within the enclosed area by moving the rods in the direction of the arrow D shown in FIG. 3 or by initially draping a sufficient predetermined number of rods within the enclosed area E prior to draping the hanger 30 on the form F. This would be a similar procedure for that which was shown in FIG. 2.

An alternative embodiment would entail having the lower recess 35' (25 of FIG. 2) opening "outwardly" such as the upper recess 35 of FIG. 4 to allow the plural re-bars to be snapped in place without confronting the enclosed area E.

Figure 5:
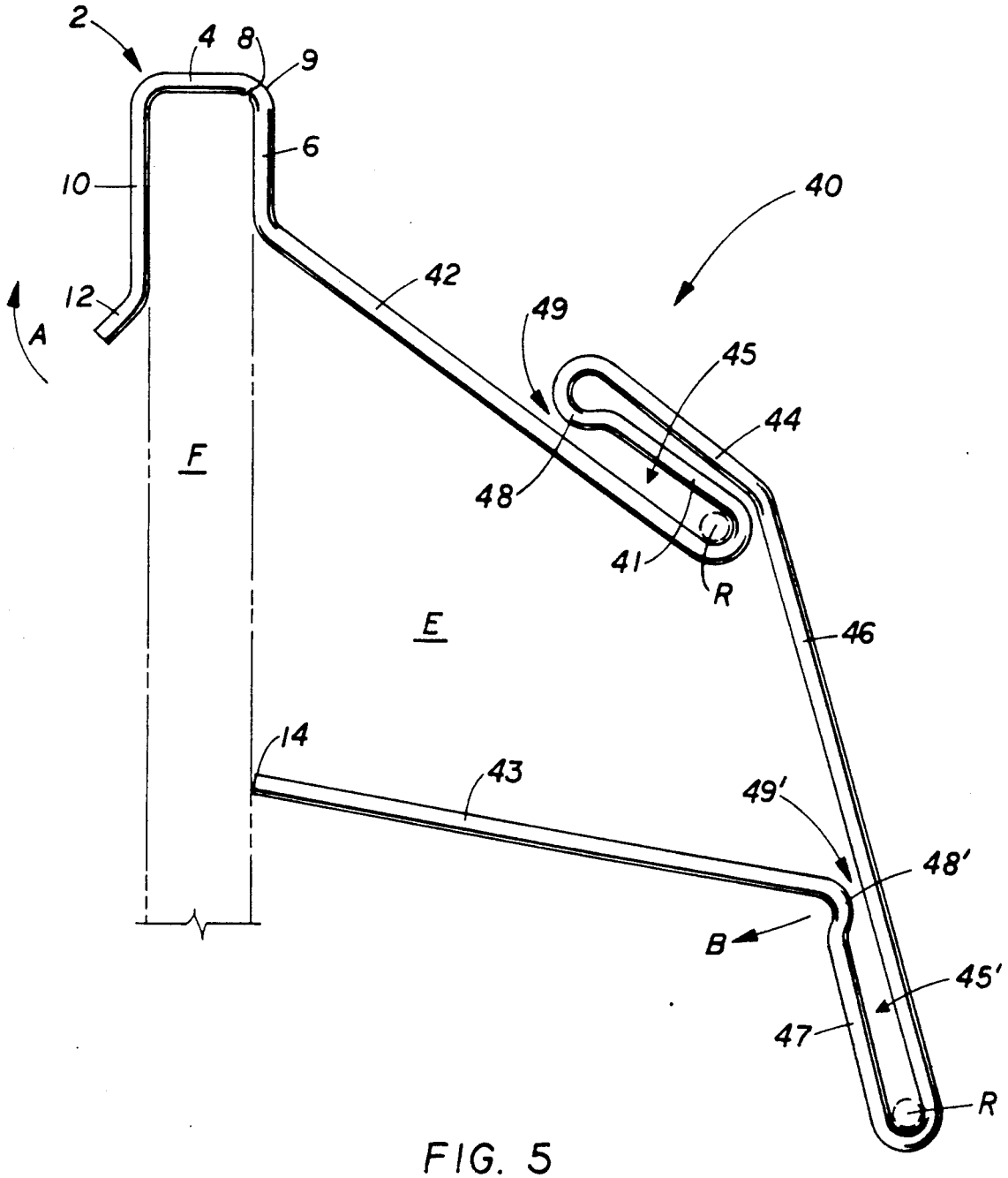
FIG. 5 is a plan view of a second hanger depicted in FIG. 3.

With respect to a further embodiment, reflected in FIG. 5, the areas of divergence between that which has been previously discussed will now be explored in greater detail while the similarities merely enumerated.

As shown, the hanger 40 includes an inverted U-shaped retainer clamp 2 having a bight portion 4, an inboard leg 6, a scoreline 8 between the bight portion 4 and the inboard leg 6, and a terminal portion 9 adjacent the score area 8. An outboard leg 10 is provided with a turnout 12 to allow dissociation of the bight and outboard legs as described. In addition, a cantilevered tip 14 abuts against an interior side wall of the form F.

The most salient striking difference between the hanger 40 and the hanger 30 is the spacing of the upper and lower recesses 45, 45' when contrasted with the FIG. 4 recesses 35, 35'. As shown in FIG. 3, this allows a combination of another set of re-bars extending further away from the form while not interfering with the hanger 30.

In essence, and as shown in FIG. 5 the most salient difference involves the length of the wall spacer leg 42 and cantilevered leg 43 when contrasted with FIGS. 4's 32, 33. Otherwise, the hanger 40 includes an inverted U-shaped retainer 2 having a bight portion 4, an outboard leg 10, a turnout 11, a weakened scoreline 8 including a terminal portion 9 adjacent the scoreline and an inboard leg 6 which in turn communicates with the wall spacer leg 42.

In addition, the cantilevered tip 14 communicates via the cantilevered leg 43 to the lower re-bar recess 45'. As shown, a plurality of re-bars R can be stored within the lower re-bar recess 45', and retained therein by pressing the re-bars from storage in the area E past the mouth of 49' by overcoming the hairpin catch 48' in the direction of the arrow B. The re-bar recess 45' includes a leg 47 downstream from the catch 48' and the transition leg 46 that extends from a lower re-bar recess 45' to an upper re-bar recess 45.

The upper re-bar recess 45 is formed by an extension of the wall spacer leg 42 that allows the recess 45 to be formed by the conjunction of the spacer leg 42 and the intermediate leg 41 interposed between legs 42 and 44. As shown, a mouth 49 is provided which allows access to the recess 45 via the hairpin catch 48.

In use and operation, one or more re-bars R is placed within the re-bar recess 45, 45', 35, 35', or 25 by initially orienting the re-bars either in the area E or above the hanger to be snapped in place. Once the hanger is draped upon a form board F, the re-bars can readily be positioned thereby facilitating a rapid concrete pour. Thereafter, once the concrete is set, the portion of the portion of the hanger which was supported by the form F is removed by breaking the hanger at the scoreline 8 and the form board is removed, and the foundation is ready for subsequent building and favorable insepction.

Moreover, having thus described the invention it should be apparent that numerous modifications and adaptations may be resorted to without departing from the scope and fair meaning of the instant application as defined here and above and described here and below by the claims.

We claim:

1. A hanger for supporting re-bar in a fixed position relative to a form board prior to and when pouring concrete, comprising, in combination:

means on said hanger for draping said hanger on the form board, means on said hanger for holding the re-bar secure until the concrete surrounding the re-bar sets including a hairpin catch which provides an obstruction to prevent removal of the re-bar, frangible means on said hanger draping means to remove a portion of said hanger which rests on the form board, whereby the re-bar is accurately positioned while the concrete is poured and in the concrete when set and said hanger does not inhibit removal of the form board because of said frangible means.

2. The hanger of claim 1 wherein said draping means includes a clamp of substantially "U" shaped configuration, inverted so as to rest on top and side surfaces of the form board, said "U" shaped clamp having a pair of legs which engage the side surfaces of the form board and a bight portion which rests on the top surface of the form board, and one said clamp leg connects with said re-bar holding means.

3. The hanger of claim 2 wherein said means for holding the re-bar secure includes a first recess formed from first and second recess legs interconnected at a lower arcuate portion, said recess legs including an upper portion defining a mouth having an opening of lesser dimension than the re-bar, whereby force must be applied to the re-bar to distort said mouth to pass the re-bar therebeyond.

4. The hanger of claim 3 wherein said mouth has a resilient memory to return to its original, unstressed state, thereby retaining the re-bar within said first recess.

5. The hanger of claim 4 including a second recess spaced from said first recess to hold additional re-bar at a different horizontal elevation than said first recess.

6. A hanger for supporting re-bars in fixed position relative to a form board prior to and when pouring concrete, comprising, in combination:

removeable clamp means for retaining said hanger on the form board, a first recess leg, a second recess leg, said clamp joined to one end of said first recess leg, said second recess leg having one end joined to another end of said first recess leg such that said first and second recess legs define a recess having a mouth remote from an area where said first and second recess legs join, said mouth including a hairpin type catch which must be distorted by widening in order for the re-bar to pass therebeyond, said first and second recess legs defining a first recess within which the re-bar is held, and said second leg having another end communicating with means to cantilever said hanger from the form board, said cantilever means having an end which abuts loosely against the form board.

7. The hanger of claim 6 including a scoreline on said clamp means for dissociating said clamp means from said recess means to free said hanger from the form.

8. The hanger of claim 7 wherein said clamp includes a draping means inverted so as to rest on top and side surfaces of the form board, said clamp having an inverted "U" shape including a pair of legs which engage the side surfaces of the form board and a bight portion which rests on the top surface of the form board, and one said clamp leg connects with said re-bar holding means by virtue of said recess legs being collectively of substantially "U" shaped configuration.

9. The hanger of claim 8 including a second recess spaced from said first recess to hold additional re-bar at a different horizontal elevation than said first recess.

10. A support hanger for re-bar to hold the re-bar in fixed relationship relative to a footing form board when pouring concrete, comprising, in combination:

an inverted, "U" shaped retainer clamp having an inboard leg, an outboard leg and an interposed bight portion dimensioned to be draped on top of the form board, said inboard leg positioned on an inner side of the form board which is to hold the concrete and provided with a weakened area at an upper portion thereof to provide a frangible area to facilitate removal of the form board by providing clearance on both a top surface and outer surface of the form board upon removal of said "U" shaped clamp's bight portion and outboard leg at said weakened area, said inboard leg communicating with a first re-bar receiving recess of substantially "U" shaped configuration and provided with a width substantially equal to a cross-sectional diameter of the re-bar, and a cantilevered leg extending from said first recess and loosely abutting against said form board adjacent a lower portion thereof to help support said hanger in a plane perpendicular to the form board.

11. The hanger of claim 10 further including:

a form board spacer leg interposed between said inboard clamp leg and said re-bar receiving recess to space said recess from the form board.

12. The hanger of claim 11 further including:

a second re-bar receiving recess integrally formed with said hanger and spaced from said first re-bar receiving recess both horizontally and vertically.

13. The hanger of claim 12 further including:

a mouth at one end of said recess to receive the re-bar.

14. The hanger of claim 13 wherein said recess is formed from two recess legs interconnected at a lower portion and said recess legs have a middle portion substantially linear and held in spaced parallel relation to each other.

15. The hanger of claim 14 wherein said recess legs are spaced from each other substantially the cross-sectional diameter of the re-bar.

16. The hanger of claim 15 wherein said recess legs have a length to accommodate plural, stacked re-bars.

17. The hanger of claim 16 wherein said mouth has a constricted opening and the re-bar must distort the mouth to pass into said re-bar receiving recess.

18. The hanger of claim 17 wherein said mouth's constriction is in the form of a hairpin catch.

19. The hanger of claim 18 wherein said hanger is formed from an integral, unitary mass of material.

* * * * *